US009469128B2

(12) United States Patent
Ishimori

(10) Patent No.: US 9,469,128 B2
(45) Date of Patent: Oct. 18, 2016

(54) PRINTING DEVICE

(71) Applicant: Seiko Epson Corporation, Tokyo (JP)

(72) Inventor: Hiroyuki Ishimori, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 14/757,966

(22) Filed: Dec. 24, 2015

(65) Prior Publication Data

US 2016/0207332 A1 Jul. 21, 2016

(30) Foreign Application Priority Data

Dec. 25, 2014 (JP) ..... 2014-261886

(51) Int. Cl.

| | |
|---|---|
| ***B41J 11/04*** | (2006.01) |
| *B41J 11/00* | (2006.01) |
| *B41J 15/00* | (2006.01) |

(52) U.S. Cl.

CPC ..... *B41J 11/04* (2013.01); *B41J 11/0095* (2013.01); *B41J 11/009* (2013.01); *B41J 15/00* (2013.01)

(58) Field of Classification Search

None

See application file for complete search history.

(56) References Cited

U.S. PATENT DOCUMENTS

| | | | | |
|---|---|---|---|---|
| 5,820,068 | A | 10/1998 | Hosomi et al. | |
| 5,884,861 | A | 3/1999 | Hosomi et al. | |
| 6,118,469 | A | 9/2000 | Hosomi | |
| 2006/0269348 | A1 * | 11/2006 | Nagata | B41J 11/0095 400/615.2 |

FOREIGN PATENT DOCUMENTS

| | | | |
|---|---|---|---|
| JP | 04-308776 | A | 10/1992 |
| JP | 09-295436 | A | 11/1997 |
| JP | 2010-030188 | A | 2/2010 |

* cited by examiner

*Primary Examiner* — Lisa M Solomon

(74) *Attorney, Agent, or Firm* — Nutter McClennen & Fish LLP; John J. Penny, Jr.

(57) ABSTRACT

A roll paper printer has a roll paper holder that holds a paper roll of recording paper wound into a roll; a platen roller that conveys recording paper delivered from the paper roll; a printhead that prints on the recording paper conveyed by the platen roller; a delivery roller around which the recording paper travels between the paper roll and platen roller; and a paper detection lever that detects the recording paper; the paper detection lever being disposed on the inside circumference side of a first curved path through which the recording paper is conveyed in contact with the delivery roller.

8 Claims, 5 Drawing Sheets

PRINTING DEVICE

Priority is claimed under 35 U.S.C. §119 to Japanese Application No. 2014-261886 filed Dec. 25, 2014.

BACKGROUND

1. Technical Field

The present disclosure relates to a printing device that delivers recording paper from a paper roll held in a roll paper holder and prints with a printhead.

2. Related Art

Roll paper printers (printing devices) that hold a roll of continuous recording paper wound into a roll, and deliver the paper from the paper roll for printing, are common. In the roll paper printer described in JP-A-H4-308776, for example, the recording paper delivered from a paper roll inside a roll paper holder passes between a platen roller and printhead, and is conveyed by rotation of the platen roller (conveyance roller). The roll paper printer disclosed in JP-A-H4-308776 can be used in two positions, with the back side down, or with the bottom down. The printer in JP-A-H4-308776 has a shape that can hold the paper roll stable when the roll diameter becomes small at the position that is the bottom of the roll paper holder when the bottom of the printer is down, and at the position that is the bottom of the roll paper holder when the back of the printer is down.

When slack develops in the recording paper on the path in the roll paper printer from inside the roll paper holder to the platen roller, the recording paper cannot be conveyed stably and conveyance precision may drop. The path of the recording paper may also change when the diameter of the paper roll changes or the position in which the roll paper printer is used changes, and this may cause the angle at which the recording paper contacts the platen roller to change. When this happens, the paper feed force is not stable and conveyance precision may drop.

JP-A-H9-295436 discloses a printer having a pair of top and bottom guide panels disposed in the paper path toward the printing position (image transfer position). The recording paper is supplied between these guide panels to the printing position. By using such guide panels in the roll paper printer disclosed in JP-A-H9-295436, a change in the path through which the recording paper passes can be prevented due to a change in the diameter of the paper roll or a change in the position in which the printer is used. As a result, slack can be prevented from developing in the recording paper, and recording paper conveyance precision can be maintained.

A paper detection unit may also be disposed between the roll paper holder and the printhead in a roll paper printer to detect the recording paper on the upstream side of the printhead. For example, a paper detection unit that detects the paper by means of a paper detection lever contacting the recording paper may be used. However, the recording paper may be deformed by contact with the paper detection lever in this type of paper detection unit, potentially leaving detection marks on the paper or causing wrinkles. Such deformation of the recording paper can be prevented by defining the paper path with guide panels, for example, but disposing the guide panels so they do not interfere with the paper detection lever is difficult and incompatible with reducing printer size. If the paper path from the roll paper holder to the platen roller changes according to the diameter of the paper roll or the position in which the printer is installed for use, simply detecting the paper with a paper detection lever becomes difficult.

SUMMARY

According to some embodiments, a printing device comprises a roll paper holder in which a paper roll is stored, a conveyance roller configured to convey recording paper delivered from the paper roll, a printhead configured to print on the recording paper conveyed by the conveyance roller, a driven roller disposed between the paper roll and the conveyance roller, and a paper detection member configured to detect the recording paper, disposed on the inside circumference side of a first curved path through which the recording paper is conveyed, and in contact with the driven roller.

Therefore the conveyance path between the conveyance roller and the driven roller is not affected by a change in the diameter of the paper roll, and the paper roll is held in the same path even if it rolls inside the roll paper holder. The orientation of the recording paper supplied to the conveyance roller can therefore be kept constant. Furthermore, because the recording paper in contact with the driven roller curves, the orientation of the recording paper is stabilized by the stiffness of the recording paper, and there is little chance of the recording paper going slack or deforming. Furthermore, because the angle of rotation through which the recording paper contacts the conveyance roller can be kept constant, variation in the conveyance force to due change in the contact angle can be suppressed. The recording paper can therefore be conveyed stably, and a drop in the conveyance precision can be suppressed. The conveyance load can also be reduced because the driven roller is a rotating body.

Furthermore, the path of the recording paper in contact with the driven roller curves, and a paper detection member for detecting the recording paper contacts the recording paper from the inside circumference side of this part (first curved path). With this direction of contact, there is little chance of the paper detection member changing the shape of the recording paper or creating detection marks or wrinkles. The recording paper can therefore be conveyed stably. In addition, because the recording paper reliably passes through a curved path defined by the driven roller, the recording paper can be reliably detected. The printer can also be built compactly by detecting the paper at a part where the paper path curves.

Some embodiments also include a paper guide disposed between the driven roller and the conveyance roller, and a second curved path through which the recording paper is conveyed in contact with the paper guide and which curves in the opposite direction as the first curved path.

Some embodiments include a recess on which the paper roll rests and rotates, and a paper roll support part configured to support the paper roll at the edge of the recess in the direction of rotation when the direction in which the paper roll rotates in the recess is the direction of rotation. In these embodiments, the driven roller is disposed to the opposite edge of the recess as the edge in the direction of rotation.

According to other embodiments, the printing device is configured to be used in a first installation position where the recess opens to the top, and a second installation position where the recess opens to a side and the driven roller is above the recess; and a rotating body configured to support the paper roll is disposed to a position opposing the bottom of the recess and within the range of paper roll rotation in the second installation position.

According to some embodiments, in a roll paper loading opening this enables dropping a paper roll in the roll paper holder, an access cover unit configured to open and closes the roll paper loading opening, and the conveyance roller and rotating body are mounted on the access cover unit.

DESCRIPTION OF EMBODIMENTS

Exemplary embodiments of the present disclosure are described below with reference to the accompanying drawings.

General Configuration

Figure 1A:
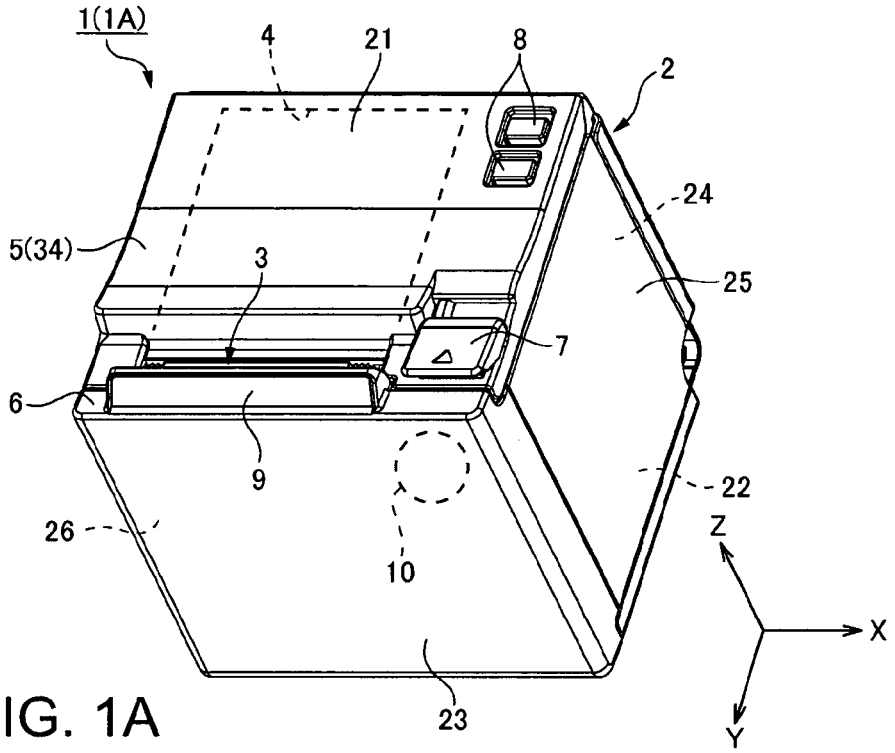
FIGS. 1A and 1B are external oblique views of a roll paper printer according to at least one embodiment of the disclosure.
Figure 1B:
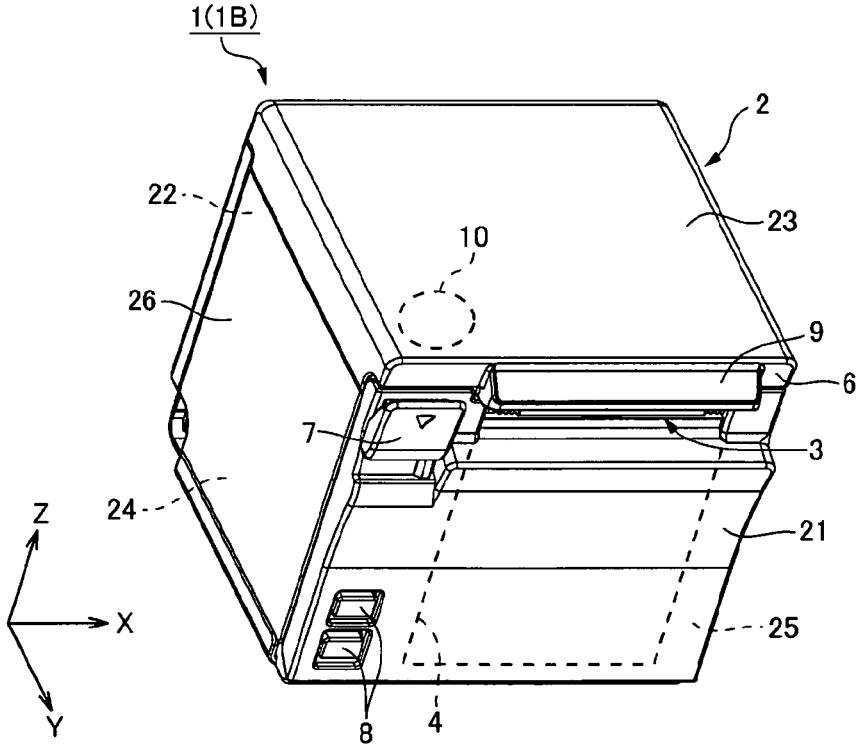

FIGS. 1A and 1B are external oblique views of a roll paper printer according to this embodiment of the disclosure. This embodiment of the disclosure is described with reference to three mutually perpendicular axes, the transverse axis X, longitudinal axis Y, and vertical axis Z. In the three directions XYZ shown in FIGS. 1A and 1B, the direction of the arrow denotes the positive (+, forward) direction, and the direction opposite the arrow is the negative (−, reverse) direction.

The roll paper printer 1 (printing device) is placed on its XY surface, which is a flat surface, for use. The roll paper printer 1 stores a paper roll 12 (see FIGS. 2A, 2B, 3A and 3B) of continuous recording paper 11 wound into a roll, and prints on the recording paper 11 delivered from the paper roll 12.

The roll paper printer 1 has a basically rectangular printer case 2.

The printer case 2 has a first side 21 in which the recording paper exit 3 is formed. In the position shown in FIG. 1A, the first side 21 is facing up (+Z direction), and the recording paper exit 3 is at the edge at the front side (+Y side) of the first side 21. This position with the recording paper exit 3 opening to the top at the front side of the printer case 2 (the front as seen from the user) is the first installation position 1A of the roll paper printer 1.

The printer case 2 has six sides, the first side 21, a second side 22 that is the bottom (−Z side) in the first installation position 1A, a third side 23 that is the front (+Y side) in the first installation position 1A, a fourth side 24 that is the back (−Y side) when in the first installation position 1A, a fifth side 25 that is one widthwise side (+X side) in the first installation position 1A, and a sixth side 26 that is the other widthwise side (−X side) in the first installation position 1A.

In the installation position shown in FIG. 1B, the first side 21 of the roll paper printer 1 faces the front (+Y direction), and the recording paper exit 3 opens to the front of the roll paper printer 1. This position is the second installation position 1B of the roll paper printer 1. In the second installation position 1B, the second side 22 forms the back (−Y side), the third side 23 forms the top (+Z side), and the fourth side 24 is the bottom (−Z side). As in the first installation position 1A, the fifth side 25 and sixth side 26 form one side (+X side) and the other side (−X side) of the width.

The configuration of the first side 21 and the third side 23 of the roll paper printer 1 when the roll paper printer 1 is placed in the first installation position 1A shown in FIG. 1A is described next.

A rectangular roll paper loading opening 4 for loading and removing a paper roll 12 is formed in the first side 21 of the printer case 2. The first side 21 has an access cover 5 that covers the roll paper loading opening 4, and a front end part 6 extending along the +Y direction edge of the roll paper loading opening 4.

Figure 2A:
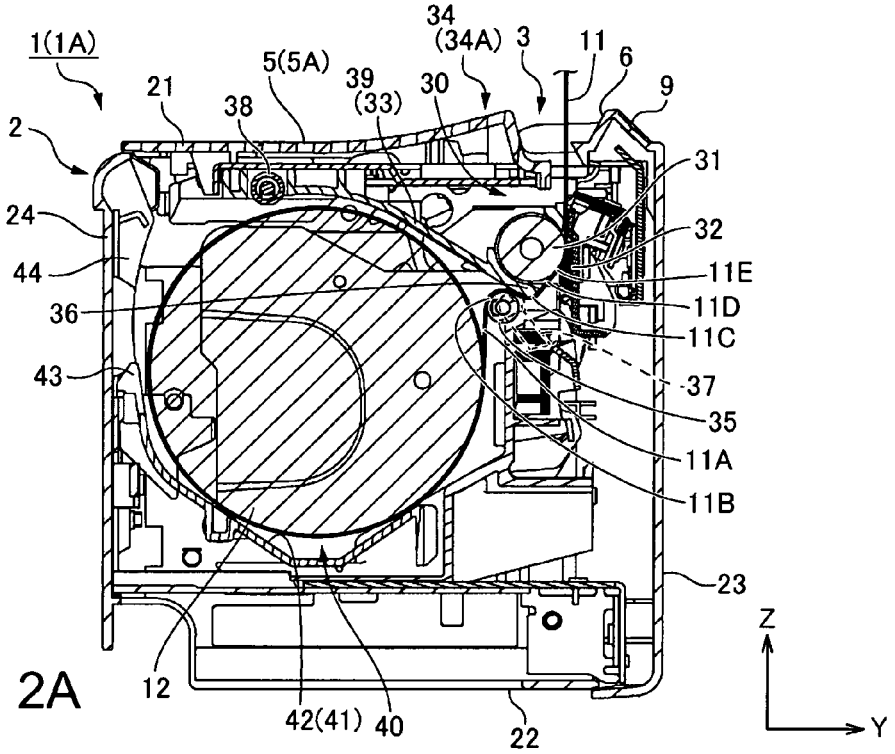
FIGS. 2A and 2B are vertical section views showing the internal configuration of the roll paper printer in a first installation position.

The access cover 5 can move between the closed position 5A shown in FIG. 2A, and an open position 5B (see FIG. 4) to which the access cover 5 pivots up (+Z direction) at the back end (−Y end) thereof. When the access cover 5 is in the closed position 5A, the recording paper exit 3 is formed as a slot on the transverse axis X between the access cover 5 and the front end part 6. The access cover 5 also has an operating lever 7 located at one side of the width (+X side) of the recording paper exit 3 (see FIGS. 1A and 1B). Lifting up on the operating lever 7 disengages a lock not shown. As a result, the access cover 5 can be opened to the top.

An operating unit 8 including a power switch is disposed at a corner at the back side (−Y side) of the access cover 5 (see FIG. 1A). The front end part 6 of the first side 21 has a negative slope in the Y-Z plane, and a display unit 9 is disposed on this slope. The display unit 9 displays such information as the operating status of the roll paper printer 1. The display unit 9 extends along the top part of the third side 23 joining the first side 21.

A NFC communication unit 10 is disposed at one side of the width (+X side) at the top of the third side 23. The NFC communication unit 10 is a device that contactlessly reads information from an NFC chip embedded in a portable terminal carried by the user, for example. The roll paper printer 1 can print based on information read by the NFC communication unit 10.

When the roll paper printer 1 is set in the first installation position 1A shown in FIG. 1A, the recording paper exit 3, display unit 9, and NFC communication unit 10 are all concentrated in the corner where the top and front sides of the printer meet. More specifically, the recording paper exit 3, display unit 9, and NFC communication unit 10 are all concentrated at a position that is easily accessible to the user from the front. When the roll paper printer 1 is set in the second installation position 1B shown in FIG. 1B, the recording paper exit 3, display unit 9, and NFC communication unit 10 are all still concentrated in a corner where the top and front sides of the printer meet.

In the first installation position 1A shown in FIG. 1A), the first side 21 with the recording paper exit 3 is the top of the printer, and printed recording paper 11 is discharged upward (+Z direction) from the top of the printer.

In the second installation position 1B shown in FIG. 1B, the first side 21 with the recording paper exit 3 is the front of the printer, and printed recording paper 11 is discharged forward (+Y direction) from the front of the printer.

The recording paper 11 can thus be discharged in two directions, up and to the front, appropriately to the operating environment of the roll paper printer 1. User convenience and operability are not impaired in either position.

In the first installation position 1A shown in FIG. 1A, the access cover 5 can pivot at the back end thereof and open upward (+Z direction), thereby opening the roll paper loading opening 4 to the top. Replacing the paper roll 12 is therefore simple by removing the paper roll 12 from the top and then dropping a new paper roll 12 in from the top.

In the second installation position 1B shown in FIG. 1B, the access cover 5 can pivot at the bottom end thereof and open forward (+Y direction), thereby opening the roll paper loading opening 4 to the front. Replacing the paper roll 12 is therefore simple by removing the paper roll 12 from the front and then dropping a new paper roll 12 in from the front.

In either position, the paper roll 12 can be easily replaced.

Figure 2B:
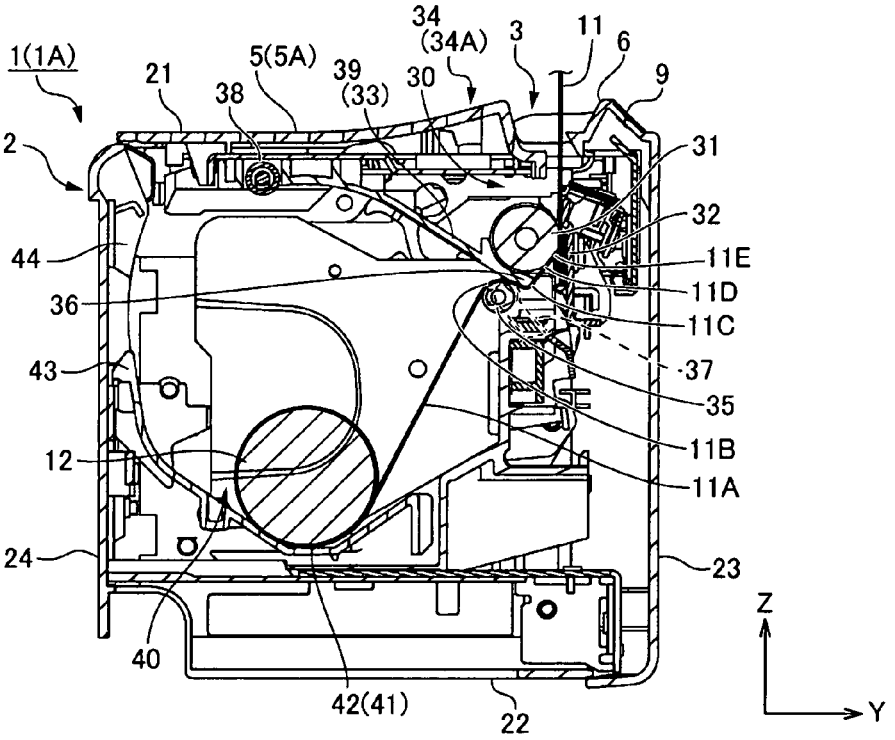
Figure 3A:
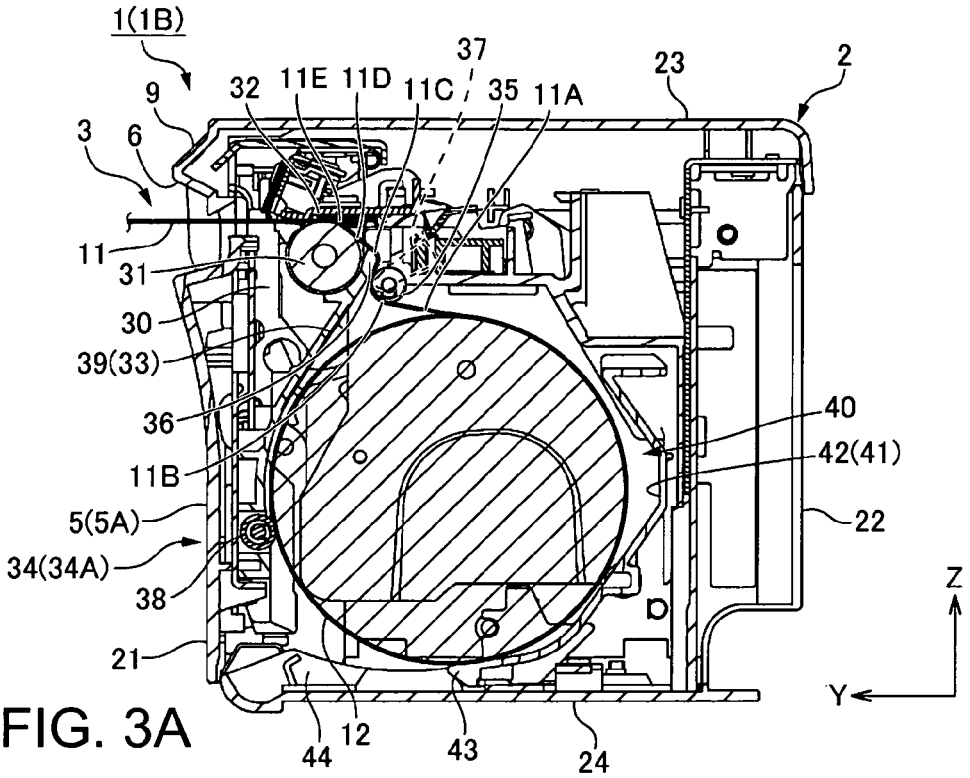
FIGS. 3A and 3B are vertical section views showing the internal configuration of the roll paper printer in a second installation position.
Figure 3B:
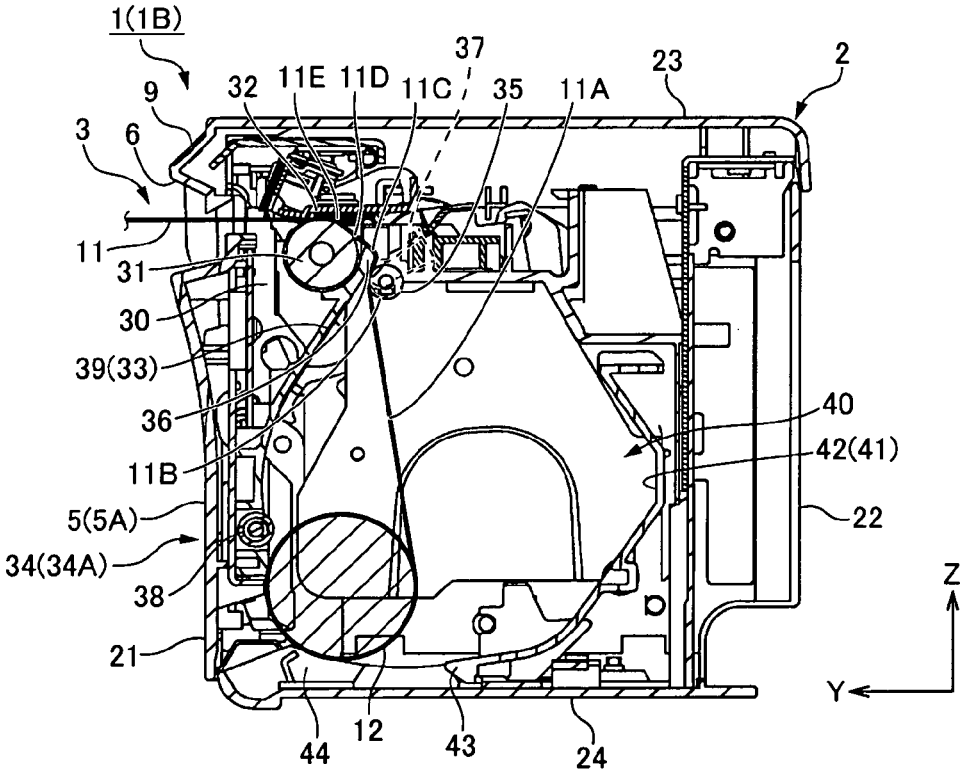
Figure 4:
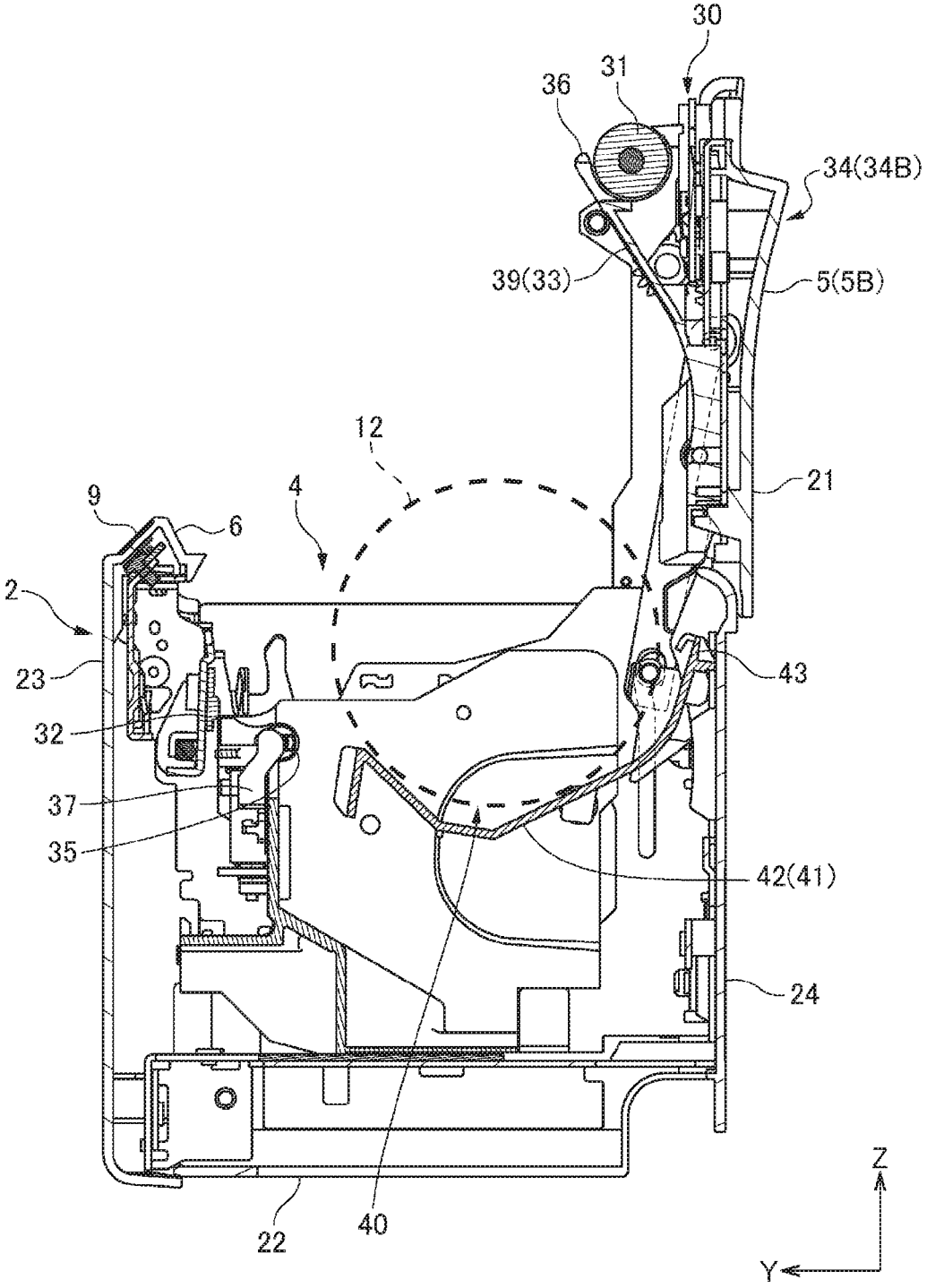
FIG. 4 is a vertical section view showing the internal configuration of the roll paper printer with the access cover open.

FIG. 2A to FIG. 4 are vertical section views showing the internal configuration of the roll paper printer 1. In FIGS. 2A, 2B, 3A and 3B the access cover 5 is closed, FIGS. 2A and 2B showing the roll paper printer 1 in the first installation position 1A (top discharge position), and FIGS. 3A and 3B showing the roll paper printer 1 in the second installation position 1B (front discharge position). In FIG. 2A and FIG. 3A, the diameter of the paper roll 12 is large, and in FIG. 2B and FIG. 3B, the diameter of the paper roll 12 is small. FIG. 4 shows the roll paper printer 1 in the first installation position 1A with the access cover 5 open.

The internal configuration of the roll paper printer 1 in the first installation position 1A is described below with reference to FIG. 2A, and FIG. 2B.

A recording paper cutter mechanism 30 for cutting the recording paper 11 is disposed near the recording paper exit 3 inside the printer case 2. Below the recording paper cutter mechanism 30 are a platen roller 31 (conveyance roller) and a printhead 32. The platen roller 31 is mounted on a platen support frame 33 that supports the access cover 5 from the back side (−Z side). The access cover 5, recording paper cutter mechanism 30, and platen roller 31 in unison with the platen support frame 33 embody an access cover unit 34 that opens and closes in unison. As shown in FIGS. 2A and 2B, when the access cover unit 34 is in the closed position 34A, the access cover 5 is in the closed position 5A. When the access cover unit 34 is in the open position 34B, the access cover 5 is in the open position 5B as shown in FIG. 4.

Below the access cover unit 34 is a roll paper compartment 40. The roll paper compartment 40 has a roll paper holder 41 that holds the paper roll 12. A recess extending in the Z direction is formed in the middle part of the bottom 42 of the roll paper holder 41. As shown in FIG. 4, when the access cover unit 34 opens, a paper roll 12 can be installed or removed from the roll paper holder 41 through the roll paper loading opening 4. The loaded paper roll 12 is supported resting so that it can roll on the bottom 42 of the roll paper holder 41.

As shown in FIGS. 2A, 2B and 4, in the first installation position 1A, the front end (+Y end) of the roll paper holder 41 rises up (in the +Z direction), and a delivery roller 35, which is a driven roller, is disposed near the top end of the roll paper holder 41. The recording paper 11 delivered from the paper roll 12 travels around the delivery roller 35, then passes over a paper guide 36 disposed at the bottom end of the platen support frame 33, and is set between the platen roller 31 and printhead 32. The recording paper 11 is conveyed by the conveyance force of the platen roller 31, passes through the recording paper cutter mechanism 30, and discharged above the printer case 2 from the recording paper exit 3.

The paper path between the roll paper holder 41 and the platen roller 31 is defined by the delivery roller 35 and the paper guide 36.

As described above, the delivery roller 35 is disposed at the front top of the roll paper holder 41, and the paper guide 36 and platen roller 31 are disposed in order diagonally to the front and up (+Y and +Z directions) from the delivery roller 35. The distal end part of the paper guide 36 protrudes below a line between the top end of the delivery roller 35 and the bottom end of the platen roller 31.

Figure 5:
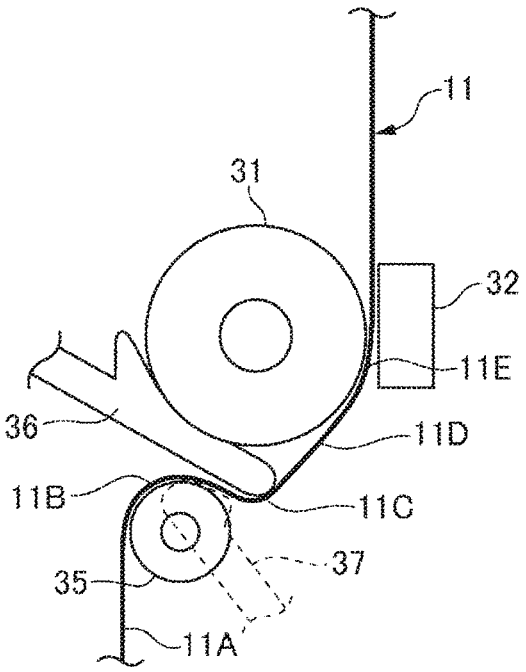
FIG. 5 is an enlarged view schematically illustrating the paper path between the roll paper holder and the platen roller.

FIG. 5 is an enlarged view of the part illustrating the paper path between the roll paper holder 41 and platen roller 31. The paper path through which the recording paper 11 passes includes a first straight path 11A extending up from the paper roll 12 to the delivery roller 35; a first curved path 11B that curves up along top of the outside surface of the delivery roller 35; a second curved path 11C that extends down from before the bottom end and along the distal end of the paper guide 36; a second straight path 11D that extends diagonally upward from the distal end of the paper guide 36 to the outside surface of the platen roller 31; and a third curved path 11E following the outside of the platen roller 31 and wrapping around the platen roller 31 through a specific angular range.

The first curved path 11B is a path in which the recording paper 11 is conveyed in contact with the delivery roller 35, and the second curved path 11C is a path through which the recording paper 11 is conveyed in contact with the paper guide 36.

The first curved path 11B and second curved path 11C curve in opposite directions, forming an S-shaped paper path.

A paper detection lever 37 (paper detection member) of a paper detector of the roll paper printer 1 is disposed below the first curved path 11B. The paper detection lever 37 contacts the recording paper 11, which is conveyed in a curving path forming a rising hump, from the inside circumference side of the hump.

The paper roll 12 can roll along the longitudinal axis Y inside the roll paper holder 41. As shown in FIGS. 2A and 2B, in the first installation position 1A, the recording paper 11 is delivered from the front end (+Y side) of the paper roll 12, and as a result the paper roll 12 rolls in a direction of rotation rolling to the −Y side (counterclockwise in FIG. 2A). The back end (−Y end) of the roll paper holder 41 rises up (+Z direction), and a paper roll support part 43 is formed at the top end.

As shown in FIG. 2A, in the first installation position 1A, when the diameter of the paper roll 12 is large, the paper roll 12 resting on the bottom 42 of the roll paper holder 41 and rotating in the direction toward the back (−Y direction) is held from the back by the paper roll support part 43. A roller 38 disposed at a position closer to the back end of the platen support frame 33 (a position near the opening center of the access cover unit 34), and a slope 39 of the platen support frame 33 extending from the roller 38 toward the platen roller 31, are disposed above the paper roll 12. The slope 39 extends along the outside of the paper roll 12, and the paper guide 36 is formed in the distal end part thereof. The roller 38 may be a roller that rotates on an axis of rotation extending on the transverse axis X, or a ball bearing.

As shown in FIG. 2B, when the diameter of the paper roll 12 becomes small, the paper roll 12 rests at a position on the bottom of the recess in the middle of the bottom 42 of the roll paper holder 41. The direction of the recording paper 11 pulled from the paper roll is different when the diameter of the paper roll 12 is large and when the diameter of the paper roll 12 is small, but because the recording paper 11 wraps around the outside of the delivery roller 35, the paper path on the downstream side of the delivery roller 35 is not affected by change in the diameter of the paper roll 12. The detection position of the paper detection lever 37 is therefore also not affected by change in the diameter of the paper roll 12, and the paper detection lever 37 can always detect the recording paper 11 at the same position.

As shown in FIGS. 3A and 3B, when the roll paper printer 1 is placed in the second installation position 1B, the roll paper holder 41 is oriented opening to the front (+Y direction) with the paper roll support part 43 at the bottom. The roll paper holder 41 is also opposite the platen support frame 33, which is now extending on the vertical axis Z, and the roller 38 is on the longitudinal axis Y.

In the second installation position 1B, the recording paper 11 is delivered from the top of the paper roll 12 (+Z side) to the front (+Y side). As a result, the paper roll 12 rotates in the +Y direction of rotation (counterclockwise in FIG. 3A). As shown in FIG. 3A, when the diameter of the paper roll 12 is large, the paper roll 12 dropped into the roll paper holder 41 rests on the paper roll support part 43, and is supported from below by the paper roll support part 43. The platen support frame 33 is also disposed beside the paper roll 12 (+Y side) in the second installation position 1B. The platen support frame 33 is opposite the bottom 42 of the roll paper holder 41, and holds the roller 38 in a position in the range of paper roll 12 rotation when in the second installation position 1B. The paper roll 12 rolling in the +Y direction is therefore supported in contact with the roller 38.

As the paper roll 12 rolls in contact with the roller 38, the diameter of the paper roll 12 decreases. When the diameter of the paper roll 12 becomes small, as shown in FIG. 3B, the paper roll 12 moves to a position in the +Y direction in front of the paper roll support part 43. The paper roll 12 contacts the platen support frame 33 extending below the roller 38, and the paper roll 12 rests on a rib 44 formed on the inside of the fourth side 24 of the printer case 2.

The direction of the recording paper 11 pulled from the paper roll is also different in the second installation position 1B when the diameter of the paper roll 12 is large and when the diameter of the paper roll 12 is small, but because the recording paper 11 wraps around the outside of the delivery roller 35, the paper path on the downstream side of the delivery roller 35 is not affected by change in the diameter of the paper roll 12. This is the same as described in the first installation position 1A above. The detection position of the paper detection lever 37 is therefore also not affected by change in the diameter of the paper roll 12, and the paper detection lever 37 can always detect the recording paper 11 at the same position.

As described above, a roll paper printer 1 according to this embodiment has a delivery roller 35, which is a driven roller around which the recording paper 11 wraps, disposed between the platen roller 31, which is a conveyance roller, and the paper roll 12. Thus comprised, the conveyance path between the platen roller 31 and the delivery roller 35 is not affected by change in the diameter of the paper roll 12, and the paper roll 12 is held in the same path even if it rolls inside the roll paper holder 41. The conveyance path between the platen roller 31 and delivery roller 35 also does not change when the installation position of the roll paper printer 1 changes. The orientation of the recording paper 11 supplied to the platen roller 31 can therefore be kept constant regardless of the orientation of the roll paper printer 1 (the discharge direction of the recording paper 11) or the diameter of the paper roll. As a result, the angle of contact between the recording paper 11 and the platen roller 31 can therefore be kept constant. Variation in the conveyance force due to variation in the wrapping angle of the paper can therefore be suppressed, paper conveyance can be kept stable, and a drop in conveyance precision can be suppressed. Furthermore, because the delivery roller 35 is a roller, the conveyance load can also be reduced.

In this embodiment of the disclosure, the path of the recording paper 11 in contact with the delivery roller 35 curves, and a paper detection lever 37 for detecting the recording paper 11 contacts the recording paper 11 from the inside circumference side of this part (first curved path 11B). With this direction of contact, there is little chance of the paper detection lever 37 changing the shape of the recording paper 11 and creating detection marks or wrinkles. The recording paper 11 can therefore be conveyed stably. In addition, because the recording paper 11 reliably passes through the first curved path 11B defined by the delivery roller 35, the recording paper 11 can be reliably detected. More specifically, the recording paper 11 can be reliably detected regardless of the installation position of the recording paper 11 (the discharge direction of the recording paper 11) or the diameter of the paper roll. Furthermore, the printer can be built compactly by detecting the paper at a part where the paper path curves.

In this embodiment of the disclosure, an S-shaped conveyance path is formed by the delivery roller 35 and paper guide 36 between the paper roll 12 and platen roller 31. With a conveyance path thus shaped, the orientation of the recording paper 11 is stabilized by the stiffness of the recording paper 11, and there is little chance of the recording paper 11 going slack or deforming. The recording paper 11 can therefore be conveyed stably, and a drop in the conveyance precision can be suppressed.

Furthermore, by wrapping the recording paper 11 around the paper guide 36 between the delivery roller 35 and platen roller 31, the path of the recording paper 11 around the delivery roller 35 can be made to curve irrespective of the location of the platen roller 31.

Furthermore, because the paper roll support part 43 is formed along the edge of the roll paper holder 41 on the opposite side as the delivery roller 35, the rolling paper roll 12 can be supported by the paper roll support part 43 at the first installation position 1A. The bottom 42 of the roll paper holder 41 also opposes the platen support frame 33, and the roller 38 is held at a position in the range of paper roll 12 rotation in the second installation position 1B. The rolling paper roll 12 can therefore be supported by the roller 38 in the second installation position 1B. In addition, because a rib 44 that can support the paper roll 12 is formed on the inside of the fourth side 24 of the printer case 2, the paper roll 12 can be supported from below in the second installation position 1B by this rib 44 when the diameter of the paper roll becomes small. Thus comprised, the rolling paper roll can be stably supported in whichever position the printer is used. Furthermore, by supporting the paper roll 12 with a roller 38, the conveyance load accompanying rotation of the paper roll 12 can be reduced. The paper feed load can therefore be reduced.

The invention being thus described, it will be apparent that it may be varied in many ways. Such variations are not to be regarded as a departure from the spirit and scope of the invention, and all such modifications as would be apparent to one skilled in the art are intended to be included within the scope of the following claims.

What is claimed is:

1. A printing device comprising:

a roll paper holder in which a paper roll is stored;

a conveyance roller configured to convey recording paper delivered from the paper roll;

a printhead configured to print on the recording paper conveyed by the conveyance roller;

a driven roller disposed between the paper roll and the conveyance roller; and a paper detection member configured to detect the recording paper, and disposed on the inside circumference side of a first curved path through which the recording paper is conveyed in contact with the driven roller.

2. The printing device described in claim 1, further comprising:

a paper guide disposed between the driven roller and the conveyance roller; and a second curved path through which the recording paper is conveyed in contact with the paper guide and which curves in a direction opposite to the first curved path.

3. The printing device described in claim 1, wherein:

the roll paper holder has a recess on which the paper roll rests and rotatable, and a paper roll support part configured to support the paper roll at an edge of the recess in the direction of rotation; and the driven roller is disposed on an opposite side of the recess as the roll paper support part.

4. The printing device described in claim 3, wherein:

the printing device is configured to be used in a first installation position where the recess opens to the top, and a second installation position where the recess opens to a side and the driven roller is above the recess; and a rotating body configured to support the paper roll is disposed at a position opposing a bottom of the recess and within a range of paper roll rotation in the second installation position.

5. The printing device described in claim 4, further comprising:

a roll paper loading opening for loading and removing a paper roll in the roll paper holder; and an access cover unit configured to open and close the roll paper loading opening; wherein the conveyance roller and rotating body are mounted on the access cover unit.

6. The printing device described in claim 1, wherein the recording paper wraps around an outside of the driven roller so that a paper path on a downstream side of the driven roller is not affected by a change in the diameter of the paper roll.

7. The printing device described in claim 4, further comprising:

a rib that supports the paper roll from below in the second installation position when a diameter of the paper roll becomes small.

8. The printing device described in claim 4, further comprising:

a roller that supports the paper roll in the second installation position.

* * * * *